United States Patent [19]

Engels

[11] 4,218,810

[45] Aug. 26, 1980

[54] PILE FABRIC SCULPTURING APPARATUS

[75] Inventor: Walter Engels, Tryon, N.C.

[73] Assignee: Milliken Research Corporation, Spartanburg, S.C.

[21] Appl. No.: 904,111

[22] Filed: May 8, 1978

[51] Int. Cl.[2] ..... D06C 23/00; D06C 13/00

[52] U.S. Cl. ..... 26/16; 26/15 R; 26/98

[58] Field of Search ..... 26/15 R, 15 L, 15 FB, 26/16, 18, 98

[56] References Cited

U.S. PATENT DOCUMENTS

| | | | |
|---|---|---|---|
| 1,593,046 | 7/1926 | Suits | 26/15 R X |
| 2,046,963 | 7/1936 | Nelson | 26/15 R |
| 4,085,700 | 4/1978 | Engels et al. | 26/15 R X |
| 4,112,560 | 9/1978 | Willbanks | 26/16 X |

FOREIGN PATENT DOCUMENTS

| | | | |
|---|---|---|---|
| 211195 | 6/1909 | Fed. Rep. of Germany | 26/15 R |
| 801646 | 1/1951 | Fed. Rep. of Germany | 26/15 R |
| 1067402 | 10/1959 | Fed. Rep. of Germany | 26/15 R |
| 1124463 | 3/1962 | Fed. Rep. of Germany | 26/15 R |

*Primary Examiner*—Robert Mackev

*Attorney, Agent, or Firm*—Earle R. Marden; H. William Petry

[57] ABSTRACT

An improved sculpturing apparatus having an asymmetric blade, improved fabric support means and an improved screen for applying stiffening agent is disclosed.

3 Claims, 11 Drawing Figures

PILE FABRIC SCULPTURING APPARATUS

Velvet has long been considered one of the most opulent of fabrics. It has been found in the robes, crowns and thrones of monarchs. In the past, the beauty and luxurious touch of velvet was obtained by incorporating silk into the pile of the fabric. This necessarily kept velvet from the less than well to do. Sculpturing enhances the beauty of velvets but adds further to the cost. While purists would insist that any true velvet must contain silk, synthetic velvets have recently appeared which rival the true velvets in luxury and touch at substantially lower cost. Methods of producing the ornate look of sculptured velvets at moderate costs have recently been developed. A method of sculpturing pile fabrics has been disclosed in allowed U.S. Patent Application Ser. No. 750,618, now U.S. Pat. No. 4,112,560. An apparatus for carrying out this process has been disclosed in U.S. Pat. No. 4,085,700. These applications describe a method of trimming the pile from selected regions of a pile fabric by applying a stiffening agent to the regions of the pile from which the pile is to be removed, hardening the stiffening agent and drawing the fabric past a blade which contacts the pile in both the stiffened and unstiffened regions. The unstiffened fibers deflect away from the blade without being cut, but the stiffened fibers cannot deflect away and are severed. The apparatus described in these applications is capable of sculpturing fabrics of truly moderate cost but it is relatively sensitive to defects in the fabrics being processed and requires precise adjustment to achieve commercially acceptable sculpturing. Further, this apparatus has proved rather unforgiving of small deviations from precise alignment, which sometimes caused the blade to damage the unstiffened fibers, sculpture unevenly or cut through the substrate.

Recently, improvements have been made in this apparatus which make it much more forgiving of deviations from ideal alignment. In particular, it has been found that it is very advantageous to use a blade having an asymmetric shape for sculpturing. When a translating blade is used for sculpturing, it has proved advantageous to support the fabric either on a rotating knurled nose bar adjacent to the blade or on a rotating nose bar having a smooth center portion and a recessed portion coinciding with the selvage of the fabric to be sculptured. The recessed portion has threads cut into it which grip the selvage of the fabric and counteract the drag of the blade on the fabric.

When patterns having straight lines which coincide with either the warp or the weft of the fabric are to be sculptured, it was found that the lines were often of uneven thickness and that it was difficult to sculpture patterns with equal line width in either the warp or weft directions. These difficulties can be minimized if the screen used for printing has apertures arranged on a uniform hexagonal lattice of equilateral triangles wherein the angle between the base of each equilateral triangle and circumferential lines on the screen is substantially 15°.

DESCRIPTION OF THE PREFERRED EMBODIMENT

For a complete understanding of the present invention, it is advantageous to refer to the teachings of allowed U.S. Patent Application Ser. No. 750,618 and U.S. Pat. No. 4,085,700 both of which are hereby incorporated by reference.

Figure 1:
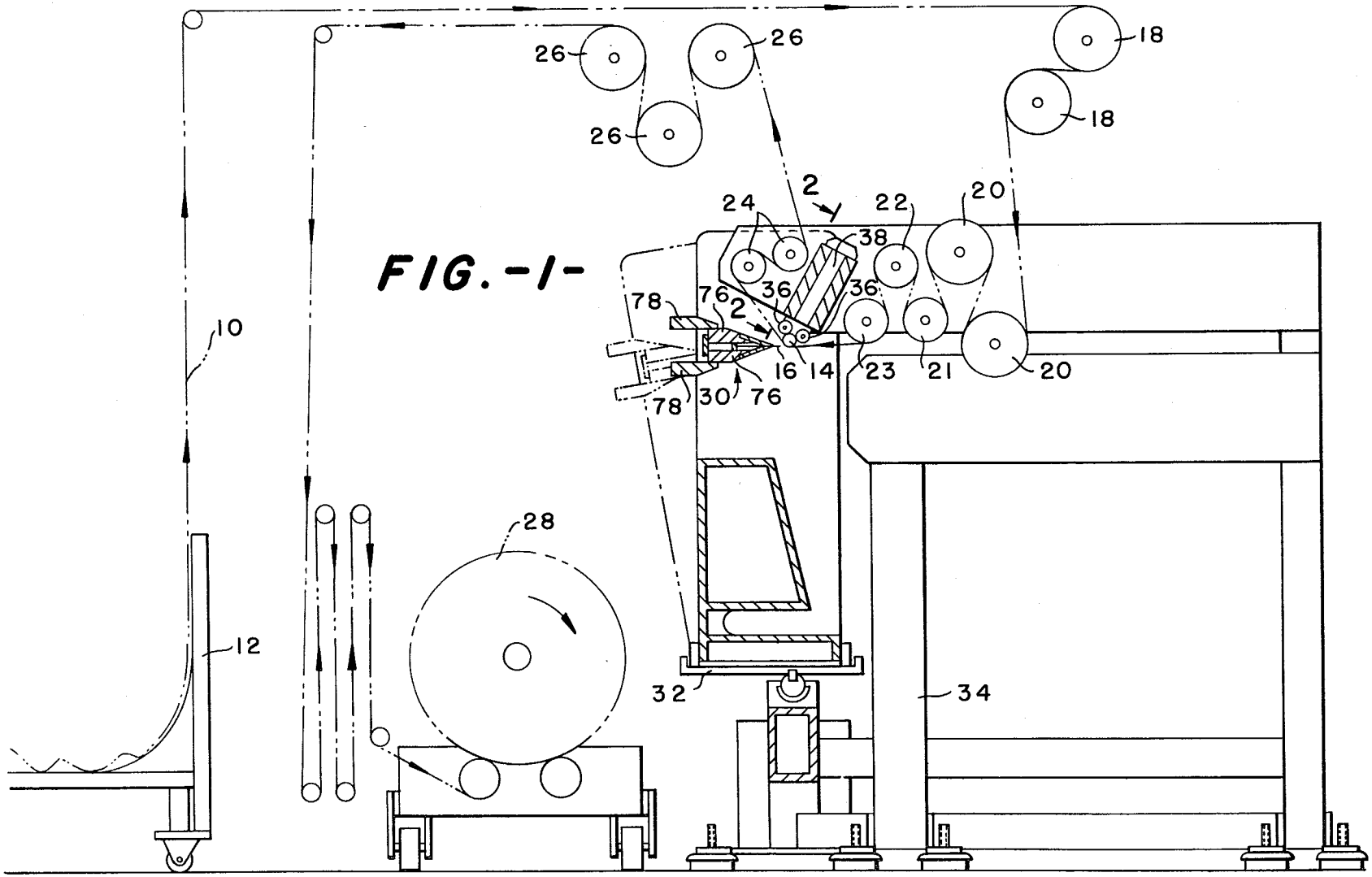
FIG. 1 is a schematic side elevation illustrating a fabric sculpturing device of the present invention.

In FIG. 1, pile fabric 10 which has been printed with stiffening agent in accordance with the teachings of the above-mentioned applications is stored in scray 12. To insure that pile fabric 10 is unwrinkled and evenly tensioned as it passes over nose bar 14 adjacent to blade 16, it is first passed over rollers 18, driven rollers 20 and then over spreader 21, roller 22, and spreader 23. Pile fabric 10 passes over nose bar 14 and is taken up by driven spreaders 24, driven rollers 26 and is stored on take up roll 28. Since it is important that pile fabric 10 be uniformly tensioned as it passes over nose bar 14 and to avoid start up problems, band knife 30 having translating blade 16 is mounted on pivotable carriage 32, while the fabric handling system is rigidly mounted on frame 34. This makes it possible to always maintain pile fabric 10 in a tensioned state even when blade 16 is retracted to allow seams to pass.

Figure 2:
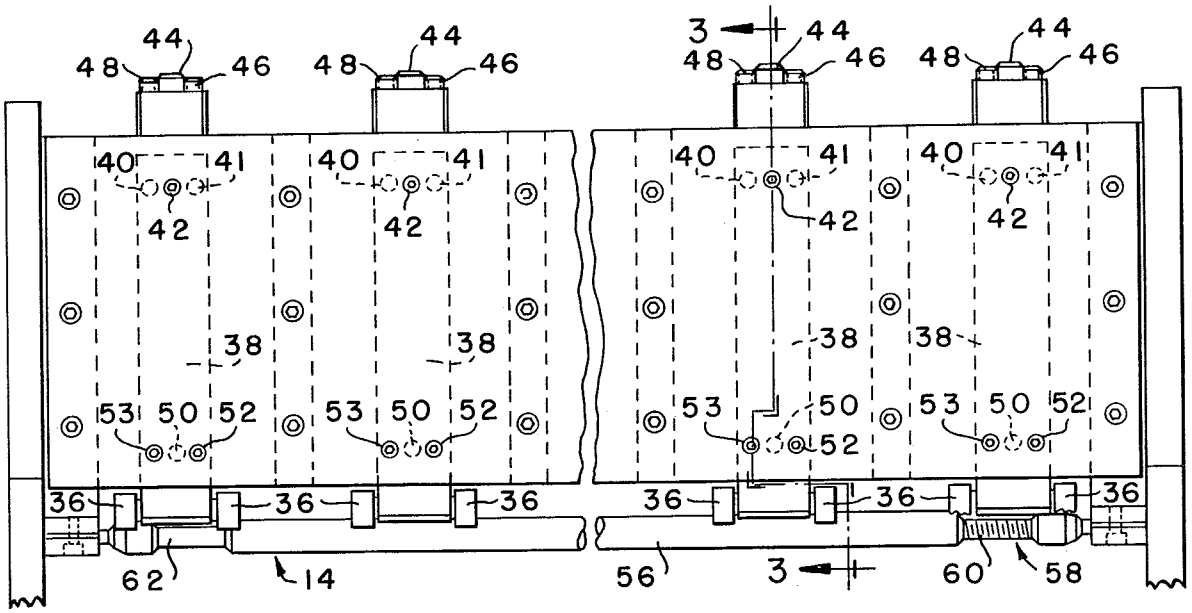
FIG. 2 is a view taken along line 2—2 in FIG. 1.
Figure 3:
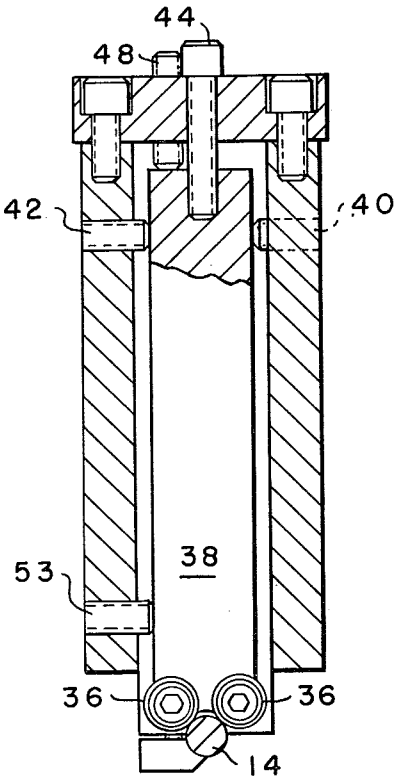
FIG. 3 is a sectional view taken along line 3—3 in FIG. 2.

Since blade 16 is a translating endless band, it is advantageous for it to have a slight amount of curvature so that it can easily be maintained in one position. The abovementioned applications teach the desirability of matching the curvature of nose bar 14 to the curvature of blade 16. FIGS. 2 and 3, illustrate an especially advantageous mechanism for supporting nose bar 14 and maintaining uniform spacing between nose bar 14 and blade 16. Nose bar 14 rests upon rollers 36. Four rollers 36 are mounted on each pillow block 38. Pillow block 38 can be extended or withdrawn by adjusting positioning screw 44. By properly adjusting set screws 40, 41, 42, 46, 48, 50, 52, and 53, it is possible to orient pillow block 38 and thereby rollers 36 mounted on pillow block 38 so that the center lines of each set of rollers 36 are substantially parallel to the portion of blade 16 nearest that set of rollers 36. For example, in FIG. 2 on any pillow block 38 by turning set screws 52 and 40 counterclockwise as viewed from their respective heads while similarly turning each set screw 53 and 41 clockwise, it is possible to tilt pillow block 38 such that the right hand pair of rollers 36 is lifted slightly above the plane of the page while the left hand pair of rollers 36 is depressed slightly below the page. Similarly by turning set screw 48 counterclockwise as viewed from its head while similarly turning set screw 46 clockwise, it is possible to rotate each set of rollers 36 slightly clockwise as viewed in FIG. 2. By turning screws 40, 41, and 50 counterclockwise as viewed from their heads while similarly turning screws 42, 52, and 53 clockwise it is possible to lower the entire pillow block into the page as seen in FIG. 2. It is also possible to raise the portion of pillow block 38 nearest nose bar 14 out of the page while lowering the portion nearest set screw 44 into the page by turning set screws 40, 41, 52, and 53 counterclockwise while turning set screws 42 and 50 clockwise. This method of supporting and positioning rollers 36 makes it possible to match the curvature of nose bar 14 to the curvature of blade 16 closely.

Figure 5:
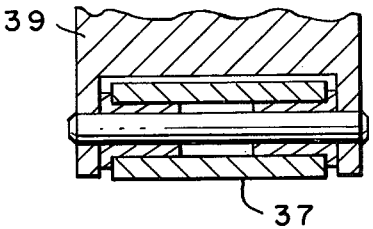
FIG. 5 is an enlarged sectional view taken along line 5—5 of FIG. 4.
Figure 4:
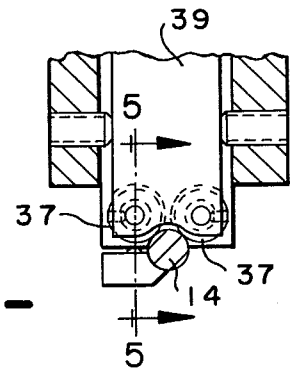
FIG. 4 illustrates an alternative construction of the roller supports shown in FIG. 3.

FIGS. 4 and 5 illustrate an alternative construction for the roller supports wherein two long rollers 37 are rotatably mounted on each pillow block 39 which can be adjusted in the same fashion as pillow block 38. Whichever construction is used, it is very advantageous that the rollers be capable of exerting a bending force or moment upon the nose bar 14 when fabric 10 is tensioned. This requirement is met in the construction shown in FIGS. 2 and 3 since the rollers 36 rotatably mounted on each pillow block 38 are spaced apart by a distance which is more than three times the diameter of the nose bar 14. In FIGS. 4 and 5, the requirement is met since the length of rollers 37 on each pillow block 39 is greater than three times the diameter of nose bar 14.

In FIG. 2, nose bar 14, supported on rollers 36, has a substantially cylindrical center portion 56, a recessed end portion 58 with right hand threads 60. Recessed end portion 62 is formed in nose bar 14 at the end opposite the end in which recessed portion 58 is formed. In operation, blade 16 (not shown in FIG. 2) moves from right to left and exerts a drag on pile fabric 10 acting toward the left. Threads 60 in recessed portion 58 grip the right hand selvage of pile fabric 10 and pull it toward the right thus countering the drag of blade 16 on pile fabric 10 and reducing the tendency for pile fabric 10 to wrinkle on nose bar 14 due to the drag of blade 16. The left hand selvage is accommodated by recessed portion 62.

Figure 6:
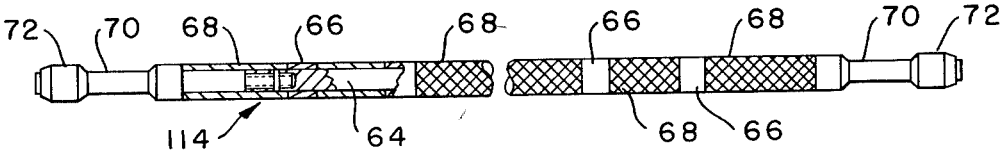
FIG. 6 is a side elevation view of an alternate nose bar for use in the sculpturing device.

FIG. 6 illustrates alternative nose bar 114 which may be used in place of nose bar 14. Nose bar 114 is assembled from substantially cylindrical core 64 having internally threaded ends, smooth surfaced hollow cylindrical thick rings 66, knurled hollow cylindrical thick rings 68 and internally threaded smooth end portions 72. The nose bar is assembled by threading one end portion 72 into core 64, sliding a plurality of alternate smooth thick rings 66 and knurled thick rings 68 cover core 64, and threading end portion 72 into core 64. Smooth thick rings 66 coincide with rollers 36 and are hardened so they are not damaged by pressing against rollers 36 while knurled thick rings 68 grip fabric 10 and counteract the drag of blade 16. Ideally, the outer diameter of the projections or knurled rings 68 will be about 0.005 inches greater than the outer diameter of smooth rings 66 to prevent fabric 10 from slipping on nose bar 114. Recesses 70 formed in end portions 72 accommodate the selvages of fabric 10. This method of construction is very advantageous since it allows smooth thick rings 66 to be hardened after they are formed. It would be difficult to heat treat an entire bar after it was machined without warping it.

Figure 7:
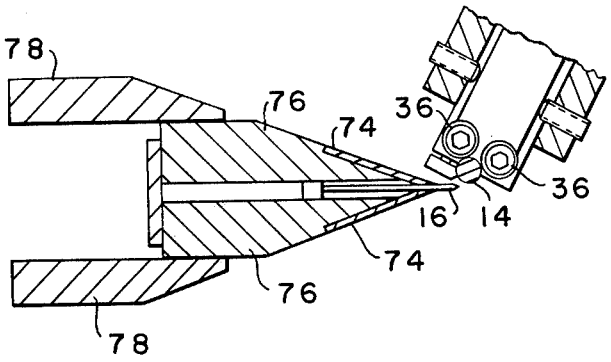
FIG. 7 is an enlarged fragmentary view of FIG. 1 showing the cutting zone in more detail.

As shown in FIG. 7, blade 16 is confined between retainer plates 74, mounted on blade supports 76 which are mounted between support beams 78 on pivotable carriage 32.

Figure 8:
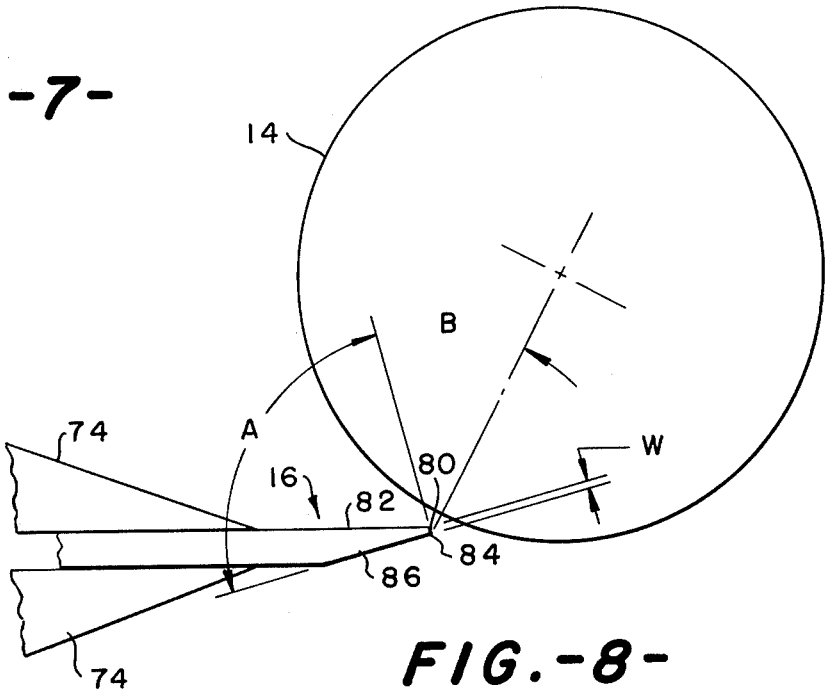
FIG. 8 is still a further enlarged fragmentary view of FIG. 1 illustrating the geometry of the blade.

As shown in FIG. 8, blade 16 has narrow facet 80 adjacent to face 82 which is adjacent to fabric 10 (omitted for clarity). Tip 84 of blade 16 is defined by the intersection of narrow facet 80 and wide facet 86. In preferred embodiments, the angle, B, between the normal to fabric 10 and narrow facet 80 will be between about 30° and about 60° while the included angle, A, between narrow facet 80 and wide facet 86 will be from about 75° to about 105°. The width, W, of narrow facet 80 will be less than about $\frac{1}{3}$ the depth of the pile on the fabric to be sculptured. In more preferred embodiments, the angle, B, between narrow facet 80 and the normal to fabric 10 is about 48° plus or minus about 5°, the included angle, A, of blade 16 is about 85° plus or minus about 5° and the width, W, of narrow facet 80 is less than about 1/10 the depth of the pile of fabric 10. In still more preferred embodiments for sculpturing of pile upholstery fabrics, the width, W, of narrow facet 80 is between about 0.003 inches and 0.010 inches. In the most preferred embodiment for sculpturing of acrylic pile upholstery fabrics, the width, W, of narrow facet 80 is about 0.008 inches plus or minus about 0.001 inches while the most preferred width, W, for sculpturing of polyester pile fabrics is about 0.006 inches plus or minus about 0.001 inches. It is found that when blade 16 has the geometry described above, damage to the unstiffened pile is minimized and sculpturing is relatively forgiving of both defects in the fabric and minor variations from optimum alignment of nose bar 14 with respect to blade 16.

When designs having straight lines parallel to either the warp or the weft of the fabric are printed using conventional screens, it is found that often the lines are of non-uniform width. It has been found that this problem is caused by non-uniform line patterns which result when the lines in the pattern are parallel to an axis of symmetry of the design from which the screen is made. Screens for printing are often made by coating a slightly tapered mandrel with known photo-sensitive materials. The portions of the mandrel which correspond to areas which are to be open in the screen are exposed to light while the remainder is masked so that it remains unexposed. Upon subsequent treatment and electroplating by known methods, a thin removable screen is formed having openings in the areas which were exposed to light.

Figure 9:
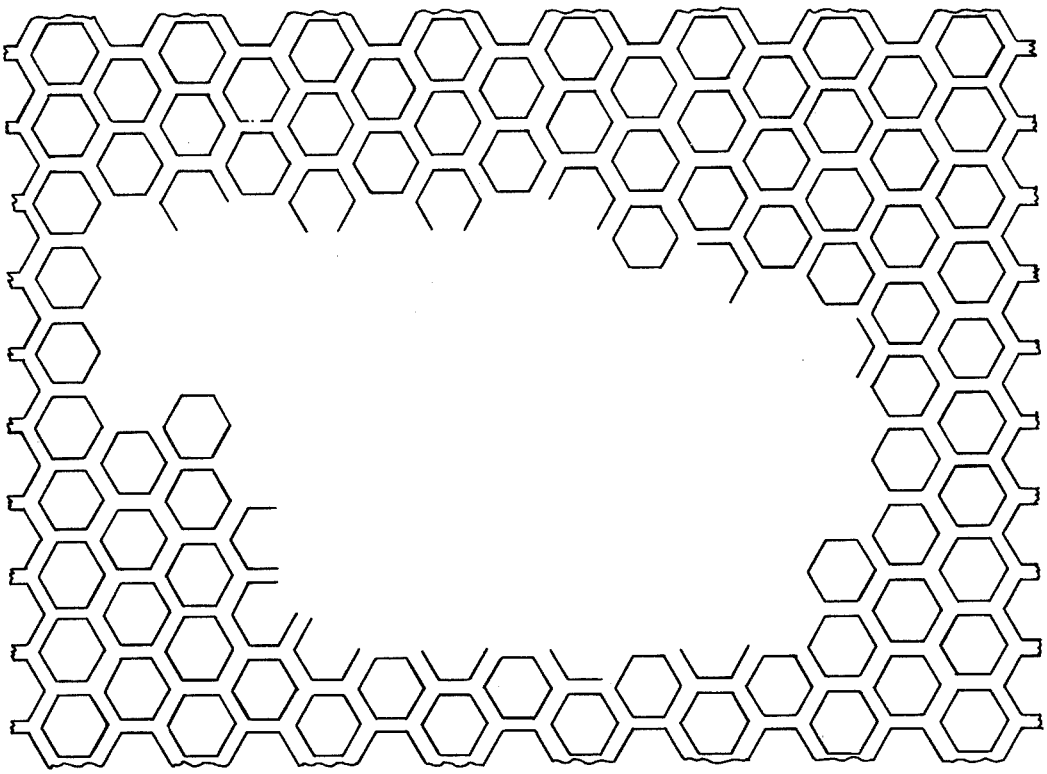
FIG. 9 is a schematic view illustrating the pattern of the background design used in forming screens for use in the present invention.
Figure 10:
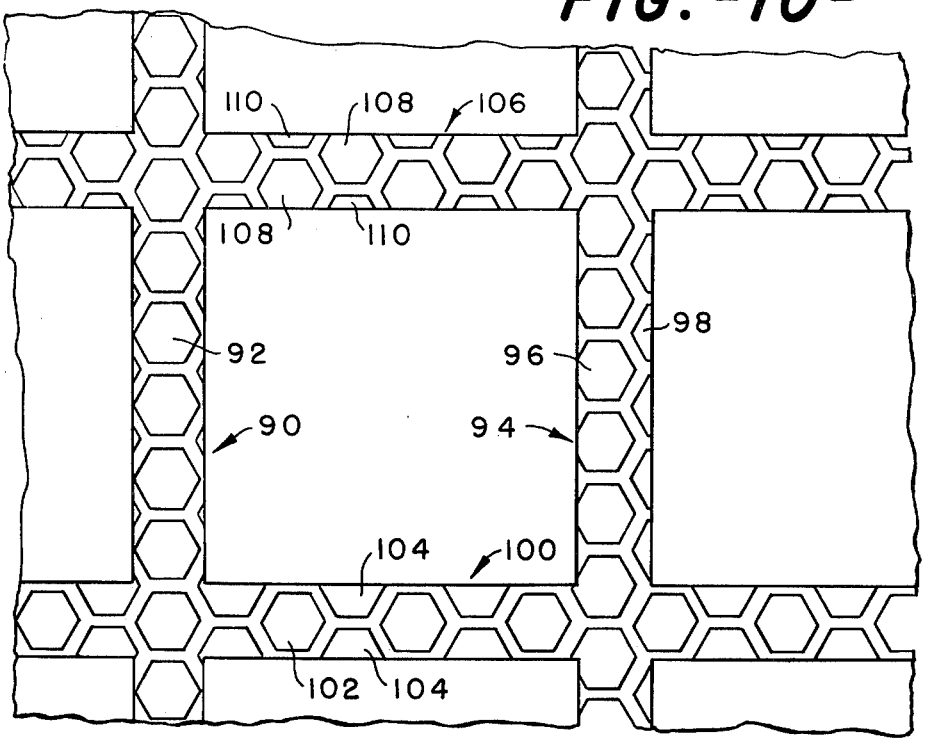
FIG. 10 is a view illustrating the array of apertures formed when axes of symmetry of the background design are parallel to the lines in the pattern.

The mandrel is normally masked by wrapping a negative around it. The negatives are usually sequentially exposed to a background pattern and a design pattern. A typical background pattern is shown in FIG. 9. FIG. 10 illustrates a typical pattern resulting when the lines in the design pattern are parallel to an axis of symmetry of the background pattern. Vertical line 90 is composed of a series of fully open hexagons 92 while vertical line 94 is composed of two series of partial hexagons 96 and 98. Similarly, it can be seen that horizontal line 100 is composed of an alternating series of one full hexagon 102 followed by two half hexagons 104 while horizontal line 106 is composed of a series of partial hexagons 108 and 110. If a screen such as is depicted in FIG. 10 is used for applying adhesive, the amount of adhesive applied through the openings 92 in vertical line 90 will be greater than the amount applied through the openings 96 and 98 in vertical line 94. There are two principal reasons for this effect. First, when the mandrel is plated, the smaller holes 96 and 98 in lines 94 will tend to close up more than the holes 92 in line 90. Thus, the actual total open area formed by the holes 96 and 98 in line 94 will be less than the open area of the holes 92 in line 90. Indeed, holes 98 may close up entirely. Second, even if the percentage open area of the two were the same, more adhesive would flow through the holes in line 90 since more adhesive will flow through a large hole than through two small holes even if the total area of the two small holes combined is equal to the area of the large hole. Similarly, it can be seen that more adhesive will be deposited through vertical line 90 than through horizontal lines 100 or 106. It is difficult to say whether more adhesive would be deposited through horizontal line 100 or horizontal line 106, but it is certain that in many cases the amounts deposited will differ. These effects are undesirable since uneven sculpturing usually results when more adhesive is applied to one line than another. This effect is especially noticeable when regular patterns such as checkerboards or evenly spaced stripes are sculptured.

Figure 11:
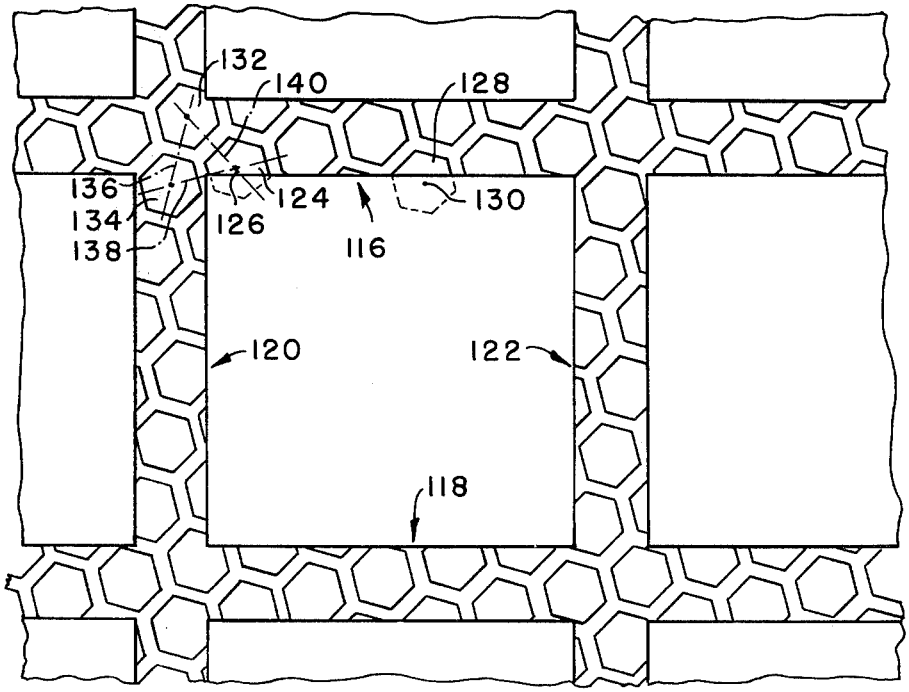
FIG. 11 is a view illustrating the array of apertures properly used for printing patterns having lines which are parallel to the warp or weft directions.

It has been found that these effects are minimized if no axis of symmetry of the background pattern is parallel to lines in the design pattern. If the background pattern has spaced apart apertures located on the vertices of an array of uniform equilateral triangles, this requirement is met by positioning the background pattern such that there will be a 15° angle between the axis of symmetry of the background pattern and circumferential lines on the screen. FIG. 11 illustrates a screen for printing lines in both the warp and weft directions using the present invention. On the screen shown in FIG. 11, the apertures define longitudinal or weft lines 116 and 118 and circumferential or warp lines 120 and 122. It can be seen that the geometric centers of adjacent apertures are located on the vertices of an array of equilateral triangles. The term "geometric center" of an aperture is to be understood to indicate the point where the center of that aperture would be if that aperture were complete whether or not the actual aperture is complete. For example in line 116, the geometric center of partial hexagon 124 would be located at point 126 and the geometric center of partial hexagon 128 would be at point 130. Thus, in FIG. 11, it can be seen that apertures 124, 132, and 134 define an equilateral triangle having sides 136, 138 and 140. The angle between side 136 and the circumferential direction is substantially 15°. The angle between side 138 and the longitudinal direction is substantially 15°. The angle between side 140 and either the longitudinal or circumferential direction is substantially 45°. All of the apertures shown in FIG. 11 are located such that their geometric centers define an array of equilateral triangles each having one side which defines a 15° angle with respect to the circumferential direction, another which defines a 15° angle with respect to the longitudinal direction and a third which defines a 45° angle with respect to both the circumferential and longitudinal directions.

It is not necessary that the apertures be hexagons as long as their geometric centers are located at the vertices of a uniform array of equilateral triangles satisfying the condition set out above. In the case of apertures having generalized shapes, the geometric center of any aperture is located at the point where the center of area of that aperture would be if it were complete whether the aperture is complete or incomplete. For example, the geometric center of a partial circle would be at the center of curvature of the arc of the partial circle.

If the conditions set forth above are satisfied, lines in the warp and weft directions will be printed properly so that lines which should be of uniform width will be uniform.

As my invention, I claim:

1. An apparatus for trimming the pile of a fabric having areas of fibers stiffened by an adhesive and areas of unstiffened fibers comprising: a frame, blade cutter means pivotally mounted on said frame, means to supply pile fabric to be trimmed into cutting relationship to said cutting means and a second means mounted adjacent to said cutting means to maintain the fabric into contact with said cutting means, said second means including a substantially cylindrical elongated member having a body portion with gripping means thereon to counteract the drag of the blade of said cutting means on the pile fabric being trimmed, said substantially cylindrical member having a first recessed portion at one end thereof adapted to contact the selvedge of the pile fabric and having a diameter smaller than the diameter of said body portion, said gripping means including a plurality of threads formed in said recessed portion with a pitch opposite to the drag on the pile fabric imposed thereon by the blade of said cutting means to cause the selvedge of the pile fabric to be directed outwardly from said body portion.

2. The apparatus of claim 1 wherein said substantially cylindrical member further includes a second recessed portion on the end of said member opposite to said first threaded recessed portion and having a diameter less than the diameter of said body portion.

3. The apparatus of claim 2 wherein the body portion of said substantially cylindrical member is substantially smooth.

* * * * *